US007937854B2

(12) United States Patent
Kilgore

(10) Patent No.: US 7,937,854 B2
(45) Date of Patent: May 10, 2011

(54) ARTICLE OF FOOTWEAR HAVING FORCE ATTENUATION MEMBRANE

(75) Inventor: Bruce J. Kilgore, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1156 days.

(21) Appl. No.: 11/269,875

(22) Filed: Nov. 8, 2005

(65) Prior Publication Data

US 2007/0101612 A1 May 10, 2007

(51) Int. Cl.
*A43B 21/32* (2006.01)
*A43B 21/26* (2006.01)

(52) U.S. Cl. ..... 36/37; 36/27; 36/35 R

(58) Field of Classification Search ..... 206/27, 206/35 R, 36 R, 36 A–36 C, 37
See application file for complete search history.

(56) References Cited

U.S. PATENT DOCUMENTS

| | | | | | |
|---|---|---|---|---|---|
| 4,709,489 | A * | 12/1987 | Welter | 36/27 |
| 5,402,588 | A * | 4/1995 | Graham et al. | 36/28 |
| 5,560,126 | A | 10/1996 | Meschan et al. | |
| 5,561,920 | A * | 10/1996 | Graham et al. | 36/27 |
| 5,611,152 | A * | 3/1997 | Richard et al. | 36/28 |
| 5,615,497 | A | 4/1997 | Meschan | |
| 5,797,199 | A * | 8/1998 | Miller et al. | 36/28 |
| 5,806,210 | A | 9/1998 | Meschan | |
| 5,918,384 | A | 7/1999 | Meschan | |
| 5,970,628 | A * | 10/1999 | Meschan | 36/42 |
| 6,662,469 | B2 * | 12/2003 | Belley et al. | 36/16 |
| 6,823,612 | B2 * | 11/2004 | Manz et al. | 36/103 |
| 7,254,906 | B2 * | 8/2007 | Morris et al. | 36/28 |
| 2004/0163280 | A1 * | 8/2004 | Morris et al. | 36/28 |

* cited by examiner

*Primary Examiner* — Mickey Yu
*Assistant Examiner* — Sharon M Prange
(74) *Attorney, Agent, or Firm* — Banner & Witcoff, Ltd.

(57) ABSTRACT

An article of footwear includes an upper and a sole assembly including a midsole. A cavity is formed in the midsole and has a cavity wall, with a groove formed in the cavity wall. A membrane is received in the groove and extends across the cavity. An upper member is secured to an upper surface of the midsole, with a portion of the upper member extending across the cavity.

27 Claims, 3 Drawing Sheets

ARTICLE OF FOOTWEAR HAVING FORCE ATTENUATION MEMBRANE

FIELD OF THE INVENTION

This invention relates generally to an article of footwear, and, in particular, to an article of footwear having a membrane that provides force attenuation to absorb impacts.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

It would be desirable to provide a footwear cushioning system that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a midsole having a membrane positioned therein. In accordance with a first aspect, an article of footwear includes an upper and a sole assembly including a midsole. A cavity is formed in the midsole and has a cavity wall, with a groove formed in the cavity wall. A membrane is received in the groove and extends across the cavity. An upper member is secured to an upper surface of the midsole, with a portion of the upper member extending across the cavity.

In accordance with another aspect, an article of footwear includes an upper and a sole assembly secured to the upper. The sole assembly includes a midsole having an upper surface and a lower surface. An aperture is formed in a heel portion of the midsole and has a wall. A groove is formed in the wall, and a membrane is received in the groove and extends across the aperture. A convex upper member is secured to the upper surface of the midsole, with a portion of the upper member extending across the cavity and contacting an upper surface of the membrane in a static condition. An outsole is secured to the lower surface of the midsole.

In accordance with a further aspect, an article of footwear includes an upper and a sole assembly including a midsole. A cavity is formed in a heel portion of the midsole and has a cavity wall and a peripheral upper edge. A groove is formed in the cavity wall. An elastomeric membrane has a plurality of apertures proximate a peripheral edge of the membrane. The membrane is received in the groove and extends across the cavity. An upper member is secured to an upper surface of the midsole, with a portion of the upper member extending across the cavity. At least one notch is formed in the peripheral upper edge of the cavity.

Substantial advantage is achieved by providing a membrane in a midsole of an article of footwear. In particular, certain embodiments of such an article of footwear provide improved attenuation of impact forces. Other advantages include enhancement of the transition from heel strike to peak heel impact and the creation of lateral and medial banking effects, thereby promoting more effective lateral cutting movements by the user.

These and additional features and advantages disclosed here will be further understood from the following detailed disclosure of certain embodiments.

Figure 1:
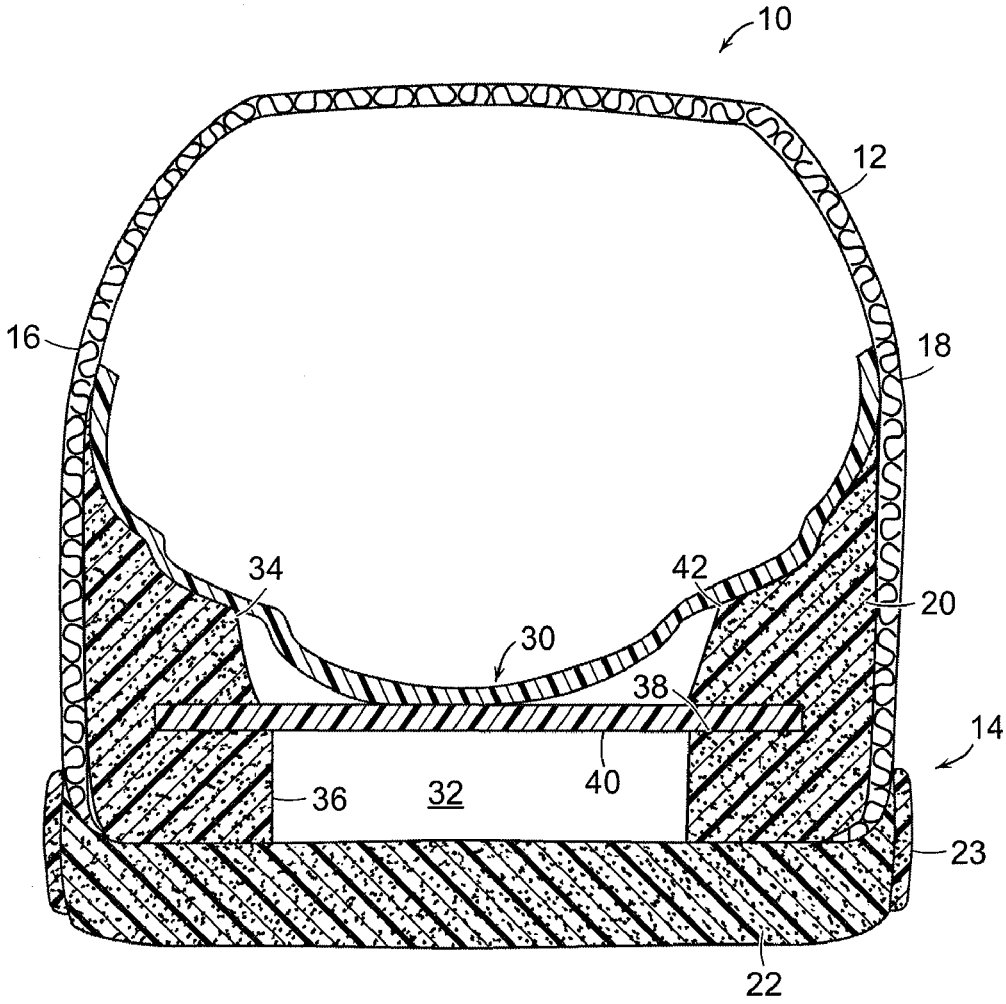
FIG. 1 is a section view of an embodiment of an article of footwear with a membrane supported within the midsole of the article of footwear.

The figures referred to above are not drawn necessarily to scale and should be understood to provide a representation of the invention, illustrative of the principles involved. Some features of the article of footwear with a membrane depicted in the drawings have been enlarged or distorted relative to others to facilitate explanation and understanding. The same reference numbers are used in the drawings for similar or identical components and features shown in various alternative embodiments. Articles of footwear with a membrane as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 20, and an outsole 22. In the illustrated embodiment a trim member 23 is secured to an exterior of footwear 10, covering the seam between upper 12 and outsole 22.

Midsole 20 is attached to upper 12 and functions as the primary shock-attenuating and energy-absorbing component of footwear 10. Midsole 20 may be secured to upper 12 by adhesive or other suitable means. Suitable materials for midsole 20 include polymer foam materials such as ethylvinylacetate or polyurethane, or any other material that compresses resiliently. Outsole 22 is attached to the lower surface of midsole 20 by adhesive or other suitable means. Suitable materials for outsole 22 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

Figure 2:
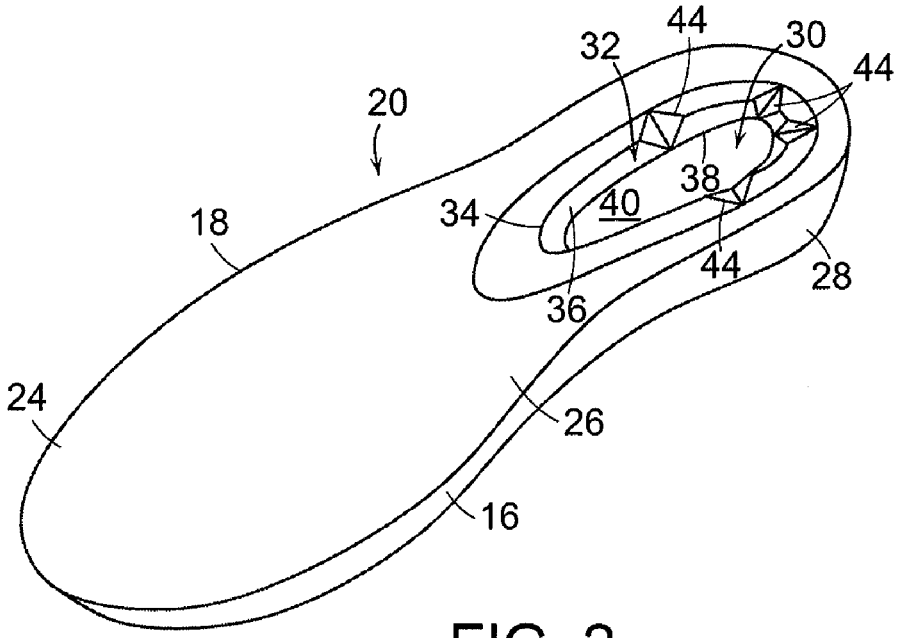
FIG. 2 is perspective view of the midsole of the article of footwear of FIG. 1.

Midsole 20 is seen more clearly in FIG. 2. For purposes of general reference, as illustrated here with respect to midsole 20, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, etc., refer to directions relative to footwear 10 itself. Midsole 20 is shown in FIG. 2 to be disposed substantially horizontally, as it would be positioned on a horizontal surface when worn by a wearer. However, it is to be appreciated that midsole 20 and footwear 10 need not be limited to such an orientation. Thus, in the illustrated embodiment of FIG. 1, rearwardly is toward heel portion 28, that is, to the right as seen in FIG. 2. Naturally, forwardly is toward forefoot portion 24, that is, to the left as seen in FIG. 2, and downwardly is toward the bottom of the page as seen in FIG. 2. Top refers to elements toward the top of the page as seen in FIG. 2, while bottom refers to elements toward the bottom of the page as seen in FIG. 2. Inwardly is toward the center of midsole 20 or footwear 10, and outwardly is toward the outer peripheral edge of midsole 20 or footwear 10.

A support assembly 30 is located in midsole 20. Support assembly 30 includes a cavity 32, formed in midsole 20 and having a peripheral upper edge 34 and a cavity wall 36. In the illustrated embodiment cavity 32 is an aperture extending through midsole 20.

A groove 38 is formed in cavity wall 36. Groove 38 receives a membrane 40. In a preferred embodiment, membrane 40 is formed of an elastomeric material. Exemplary materials for membrane 40 include urethane, rubber, and polyether-block co-polyamide polymers (sold as Pebax® by ATOFINA Chemicals of Philadelphia, Pa.). Other suitable materials for membrane 40 will become readily apparent to those skilled in the art, given the benefit of this disclosure. Membrane 40 may, in certain embodiments, have a thickness of between about 1.5 mm and about 2.0 mm thick.

In the illustrated embodiment, cavity 32 and membrane 40 are substantially elliptical, with the forward portion of the elliptical shape being smaller than the rear portion. It is to be appreciated that cavity 32 and membrane 40 may have other shapes and that other suitable shapes will become readily apparent to those skilled in the art, given the benefit of this disclosure.

In certain embodiments, midsole 20 is molded about membrane 40. To form midsole 20, membrane 40 may be held in position in a mold. The material used to form midsole 20, such as polyurethane, is then poured into the mold such that the peripheral edge of membrane 40 is covered by the poured material. Consequently, the peripheral edge of membrane 40 is captured within the midsole 20 when the poured material has cooled and set. Thus, groove 38 in which membrane 40 is received is formed during the molding process. In certain embodiments, the materials for membrane 40 and midsole 20 may be such that they tend to bond to one another. For example, when the poured material for midsole 20 is polyurethane, the use of a material such as urethane for membrane 40 helps promote bonding between membrane 40 and midsole 20, thereby helping retain membrane 40 in position within midsole 20.

In the illustrated embodiment, support assembly 30 is positioned in heel portion 28. It is to be appreciated that in certain embodiments support assembly 30 may be positioned in another portion of midsole 20, or it may span over one or more portions, such as heel portion 28 and midfoot portion 26.

An upper member 42 is positioned on the upper surface of midsole 20 and extends across cavity 32. In certain embodiments, a central portion of upper member 42 is convex toward membrane 40 and may actually contact membrane 40 in a static condition. The outer edges of upper member 42, as well as the outer edges of the upper surface of midsole 20 may be curved upwardly, providing a cradle for the calcaneous or heel bone of the user's foot, thereby substantially conforming to a foot pad of the user's heel.

Upper member 42 may be formed of a substantially rigid material. In certain embodiments, upper member 42 has a stiffness greater than that of membrane 40 such that upper member 42 will deform less than membrane 40, thereby allowing the deflection from impact to be primarily absorbed by membrane 40. Suitable materials for upper member 42 include nylon, polyester elastomer, urethane and plastics such as Surlyn®.

Upon impact of the user's heel with upper member 42, upper member 42 is forced downwardly and engages membrane 40, thereby deforming and extending membrane 40 downwardly. The tension created in membrane 40 as it stretches decelerates the load and attenuates the force of the user's impact. As membrane 40 its maximum range of deflection, the rate of stiffening of membrane 40 will slow.

In the embodiment illustrated in FIG. 1, upper 12 extends over a portion of an exterior surface of upper member 42 and an exterior surface of midsole 20, and is wrapped about a lower outer edge of midsole 20 such that midsole 20 is not visible from the exterior of footwear 10. Outsole 22 is then secured to the lower surface of midsole 20. Such footwear is commonly referred to as double-lasted footwear. In other embodiments, midsole 20 is not covered by upper 12 and is visible from the exterior of footwear 10.

In certain embodiments, as illustrated in FIG. 2, notches 44 are formed in midsole 20 about peripheral upper edge 34 of cavity 32. Notches 44 act as crumple zones, and serve to force deflection of upper member 42 and membrane 40 in key regions to promote movement of upper member 42 and membrane 40 in particular directions. For example, notches 44 may be used to promote heel-to-toe transition, as well as banking for lateral and medial cutting movements. In the embodiment illustrated in FIG. 2, a notch 44 is formed in lateral side 18 of peripheral upper edge 34 of cavity 32, and an opposed notch 44 is formed in medial side 16 of peripheral upper edge 34 of cavity 32. A pair of spaced apart notches 44 is also formed in a rear portion of peripheral upper edge 34 of cavity 32. Notches 44 may have any desired shape. In the illustrated embodiment, notches 44 are formed by making two cuts in peripheral upper edge 34, with the cuts angling down into midsole 20 and toward one another, forming a substantially V-shaped notch 44.

Figure 3:
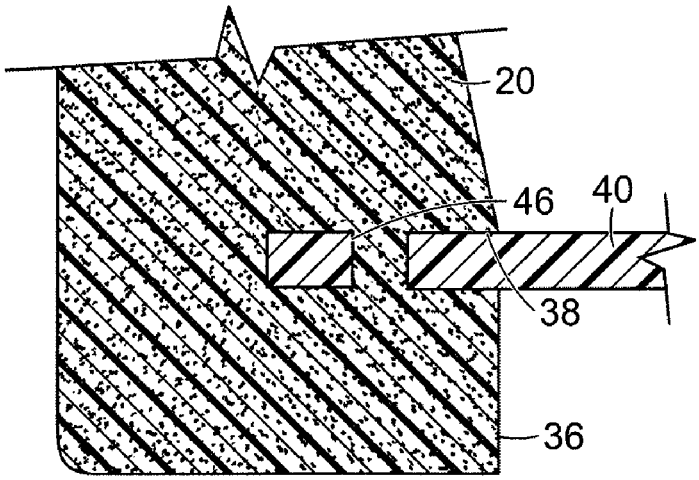
FIG. 3 is an enlarged section view, partially broken away, of an alternative embodiment of the article of footwear of FIG. 1, showing a portion of the midsole and the membrane.

In certain embodiments, as illustrated in FIG. 3, a plurality of apertures 46 is formed in membrane 40 proximate its peripheral edge, each of which extends through membrane 40. A portion of midsole 20 extends through each aperture 46, thereby helping anchor membrane 40 within midsole 20. As the material for midsole 20 is poured into the mold in which membrane 40 is held, it flows into apertures 46, thereby filling apertures 46.

Figure 4:
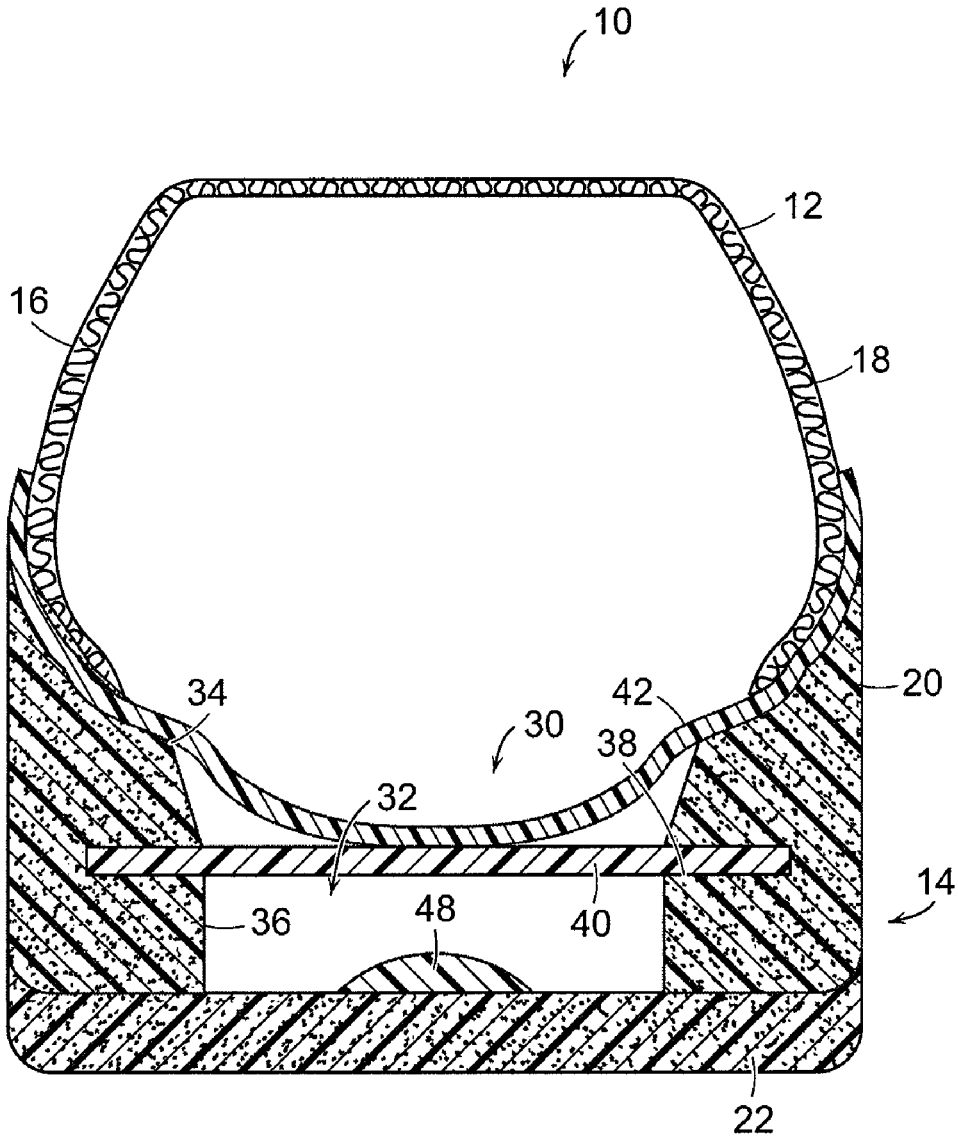
FIG. 4 is a section view of another embodiment of an article of footwear with a membrane supported within the midsole of the article of footwear.

In certain embodiments, as illustrated in FIG. 4, upper 12 may be captured within the upper outer edges of upper member 42. Upper member 42 and upper 12 may be secured to one another with adhesive or other suitable fastening means. In such an embodiment, midsole 20 is visible from an exterior of footwear 10.

As can be seen here, an insert 48 may be positioned in a lower portion of cavity 32, beneath membrane 40. A lower surface of insert 48 may be substantially flush with a lower surface of midsole 20. An upper surface of outsole 22 is secured to a lower surface of insert 48 with adhesive or other suitable fastening means. As shown in this embodiment, insert 48 may be substantially dome-shaped. An upper surface of insert 48 serves to engage a lower surface of membrane 40 as membrane 40 deflects or deforms downwardly. It is to be appreciated that insert 48 may have any desired shape. Other suitable shapes for insert 48 will become readily apparent to those skilled in the art, given the benefit of this disclosure. Insert 48 may be formed of a visco-elastic polymer (e.g., sorbethane or silicone-based gels), or foams (e.g., ethyl vinyl acetate (EVA), polyurethane or rubber foams).

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:
an upper; and
a sole assembly secured to the upper and comprising:
a midsole having an upper surface;
a cavity formed in the upper surface of the midsole and having a cavity wall extending downwardly from the upper surface;
at least one notch formed in the upper surface of the midsole, in the cavity wall, and in a peripheral upper edge of the cavity, each notch opening toward the upper surface of the midsole and toward an interior of the cavity;
a groove formed in the cavity wall a distance below the upper surface of the midsole and below the at least one notch;
a membrane received in the groove and extending across the cavity; and
an upper member secured to an upper surface of the midsole, a portion of the upper member extending across the cavity.

2. The article of footwear of claim 1, wherein the membrane is formed of an elastomeric polymer.

3. The article of footwear of claim 1, wherein the membrane is formed of urethane.

4. The article of footwear of claim 1, wherein the midsole is formed of a foam.

5. The article of footwear of claim 1, wherein the midsole is formed of polyurethane.

6. The article of footwear of claim 1, wherein the membrane has a thickness between about 1.5 mm and about 2.0 mm.

7. The article of footwear of claim 1, wherein at least a portion of the upper member is configured to substantially conform to a foot pad of a user's heel.

8. The article of footwear of claim 1, wherein the upper member is convex toward the membrane.

9. The article of footwear of claim 1, wherein a lower surface of the upper member is in contact with an upper surface of the membrane in a static condition.

10. The article of footwear of claim 1, wherein the cavity comprises an aperture extending through the midsole.

11. The article of footwear of claim 1, further comprising a plurality of notches formed in a peripheral upper edge of the cavity.

12. The article of footwear of claim 11, wherein a first notch is formed in a lateral side of the peripheral upper edge, a second notch is formed in a medial side of the peripheral upper edge, and a pair of notches are formed in a rear portion of the peripheral upper edge.

13. The article of footwear of claim 11, wherein the sole assembly further comprises an outsole secured to the midsole.

14. The article of footwear of claim 1, further comprising an insert positioned in the cavity beneath the membrane, a lower surface of the insert being substantially flush with a lower surface of the midsole.

15. The article of footwear of claim 1, wherein the upper extends over a portion of an exterior surface of the upper member and over an exterior surface of the midsole.

16. The article of footwear of claim 1, wherein the upper is positioned within the upper member.

17. The article of footwear of claim 1, wherein the upper member is formed of a substantially rigid material.

18. An article of footwear comprising, in combination:
an upper; and
a sole assembly secured to the upper and comprising:
a midsole having an upper surface and a lower surface;
an aperture formed in the upper surface of a heel portion of the midsole and having a wall extending downwardly from the upper surface;
at least one notch formed in the upper surface of the midsole, in the wall, and in a peripheral upper edge of the aperture, each notch opening toward the upper surface of the midsole and toward an interior of the aperture;
a groove formed in the wall a distance below the upper surface of the midsole and below the at least one notch;
a membrane received in the groove and extending across the aperture; and
a convex upper member secured to the upper surface of the midsole, a portion of the upper member extending across the aperture and contacting an upper surface of the membrane in a static condition; and an outsole secured to the lower surface of the midsole.

19. The article of footwear of claim 18, wherein the membrane is formed of an elastomeric polymer.

20. The article of footwear of claim 18, wherein a lower surface of the upper member is in contact with an upper surface of the membrane in a static condition.

21. The article of footwear of claim 18, further comprising a plurality of notches formed in a peripheral upper edge of the aperture.

22. The article of footwear of claim 21, wherein a first notch is formed in a lateral side of the peripheral upper edge, a second notch is formed in a medial side of the peripheral upper edge, and a pair of notches are formed in a rear portion of the peripheral upper edge.

23. An article of footwear comprising, in combination:

an upper;

a sole assembly including a midsole having an upper surface;

a cavity formed in the upper surface of a heel portion of the midsole and having a cavity wall and a peripheral upper edge;

at least one notch formed in the upper surface of the midsole, in the cavity wall, and in the peripheral upper edge of the cavity, each notch opening toward the upper surface of the midsole and toward an interior of the cavity;

a groove formed in the cavity wall a distance below the upper surface of the midsole and below the at least one notch;

an elastomeric membrane having a plurality of apertures proximate a peripheral edge of the membrane, the membrane being received in the groove and extending across the cavity;

an upper member secured to an upper surface of the midsole, a portion of the upper member extending across the cavity.

24. The article of footwear of claim 23, wherein the membrane is formed of an elastomeric polymer.

25. The article of footwear of claim 23, wherein a lower surface of the upper member is in contact with an upper surface of the membrane in a static condition.

26. The article of footwear of claim 23, further comprising a plurality of notches formed in the peripheral upper edge of the cavity.

27. The article of footwear of claim 26, wherein a first notch is formed in a lateral side of the peripheral upper edge, a second notch is formed in a medial side of the peripheral upper edge, and a pair of notches are formed in a rear portion of the peripheral upper edge.

* * * * *